US009755287B2

(12) United States Patent
Tageman

(10) Patent No.: US 9,755,287 B2
(45) Date of Patent: Sep. 5, 2017

(54) FREQUENCY DEMULTIPLEXER

(71) Applicant: TELEFONAKTIEBOLAGET LM ERICSSON (publ), Stockholm (SE)

(72) Inventor: Ola Tageman, Göteborg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 17 days.

(21) Appl. No.: 14/777,897

(22) PCT Filed: Mar. 19, 2013

(86) PCT No.: PCT/EP2013/055631

§ 371 (c)(1),
(2) Date: Sep. 17, 2015

(87) PCT Pub. No.: WO2014/146687

PCT Pub. Date: Sep. 25, 2014

(65) Prior Publication Data

US 2016/0028137 A1 Jan. 28, 2016

(51) Int. Cl.
*H01P 5/12* (2006.01)
*H01P 1/20* (2006.01)
(Continued)

(52) U.S. Cl.
CPC ..... *H01P 1/20* (2013.01); *H01P 1/2135* (2013.01); *H01P 3/00* (2013.01); *H01P 5/12* (2013.01)

(58) Field of Classification Search
CPC .. H01P 1/20; H01P 1/2135; H01P 3/00; H01P 5/12
(Continued)

(56) References Cited

U.S. PATENT DOCUMENTS 4,168,479 A * 9/1979 Rubin ..... H01P 5/12 333/126
4,210,881 A * 7/1980 Rubin ..... H01P 1/2135 333/110
2007/0216495 A1 9/2007 Callewaert

FOREIGN PATENT DOCUMENTS

JP 2002204105 A 7/2002
WO 2008/031042 A1 3/2008

OTHER PUBLICATIONS

Zhou et al., "Design of compact microstrip duplexers for 3G mobile communication systems," IEEE, Antennas and Propagation Society International Symposium, XP010514664; ISBN: 978-0-7803-6369-4 Jul. 2000, 4 pages.

(Continued)

*Primary Examiner* — Robert Pascal
*Assistant Examiner* — Kimberly Glenn
(74) *Attorney, Agent, or Firm* — Rothwell, Figg, Ernst & Manbeck, P.C.

(57) ABSTRACT

A frequency demultiplexer comprising an input part (106) with an input port (101), a low pass filter (125) and a band-pass filter (108) with output ports (120, 145). The input part (106), the low-pass filter (125) and the band-pass filter (108) comprise open waveguide sections, and the band-pass filter (108) comprises gap-coupled resonators (130, 135, 140). The input part (106) and the low-pass filter (125) connect to the same resonator (130), the connection (121) of the low-pass filter (125) being at a first maximum distance ($L_1$) from a center point (N) of the resonator and the connection (116) of the output port (101) being at a second maximum distance ($L_2$) from said center point (N) of the resonator. The center point (N) corresponds to a wave node of a wavelength λ, where λ=2d/M, M is a positive integer value and d is the shortest end-to-end distance along the resonator.

5 Claims, 3 Drawing Sheets

(51) Int. Cl.
*H01P 1/213* (2006.01)
*H01P 3/00* (2006.01)

(58) Field of Classification Search
USPC ..... 333/126
See application file for complete search history.

(56) References Cited

OTHER PUBLICATIONS

International Search Report issued in corresponding application No. PCT/EP2013/055631 dated Jan. 7, 2014, 4 pages.

* cited by examiner

FREQUENCY DEMULTIPLEXER

CROSS REFERENCE TO RELATED APPLICATION(S)

This application is a 35 U.S.C. §371 National Phase Entry Application from PCT/EP2013/055631, filed Mar. 19, 2013, designating the United States, the disclosure of which is incorporated herein in its entirety by reference.

TECHNICAL FIELD

The present invention discloses a novel frequency demultiplexer.

BACKGROUND

Frequency multiplexers are used in order to combine a plurality of different signals into one composite signal with each of the different signals comprising a frequency component or a part of the total bandwidth of the composite signal. In order to perform the opposite operation, i.e. to separate the different signals comprised in a composite signal from a frequency multiplexer, frequency demultiplexers are used. Usually, a frequency multiplexer is reciprocal, i.e. it can be used "in the reverse direction" in order to perform demultiplexing. Likewise, frequency demultiplexers are also usually reciprocal. For this reason, although mention is mainly only made of frequency multiplexers below, the reasoning below applies to frequency demultiplexers.

It is often desired, particularly in the microwave frequency range, to have a frequency multiplexer which has as high a bandwidth as possible, i.e. a broadband frequency multiplexer, which can then be used in a number of applications, including frequency multiplexing in microwave assisted optical terabit devices and systems (Sub-Carrier Multiplexing), multi-standard and/or multi-channel communications, frequency multiplexing in high speed modems for microwave systems, ultra wideband communications and electronic warfare, in which several signals share a common antenna. Such multiplexers are also of use in test instruments, where a frequency band can be split into sub-bands in order to use a set of narrow-band function blocks One known technique for obtaining frequency multiplexers uses closed waveguides, i.e. waveguides with a cross section which has a closed profile, usually either rectangular or elliptical. One approach within this field includes band-pass filters connected to a common junction through quarter-wave pieces of closed waveguide, and another approach is to use closed waveguide band-pass filters connected in a chain (i.e. "cascaded") one after another, with decoupling resonators in between in order to block interaction between the band-pass filters in the chain. A third approach within this field is to use cascaded waveguide blocks comprising two hybrids and two band pass filters which successively filter out one band and sends it to one output port and sends other frequencies to another output port.

A drawback of closed waveguide frequency multiplexers is that they are expensive, bulky, and typically suitable only for narrowband applications.

Another known technique for obtaining frequency multiplexers is to use open waveguide technology in the form of microstrip lines, e.g. to make so called coupled line band-pass filters which are connected to a common junction, or to use microstrip lines to make so called combline diplexers.

A drawback of coupled line band-pass filters which are connected to a common junction is that a common junction for a number of band-pass filters makes the junction strongly frequency dependent, which means that all of the filters will interact heavily, thereby making it difficult to avoid unintentional transmission zeroes and pass-bands. In practice, the bandwidth of such open waveguide frequency multiplexers becomes limited.

A drawback of comb-line filter multiplexers is the appearance of spurious pass bands. Another drawback is that the design flexibility is limited, which means that it is difficult to obtain arbitrary filter characteristics.

SUMMARY

It is an object of the invention to obviate at least some of the drawbacks mentioned above and to provide an improved frequency demultiplexer.

This object is obtained by means of a frequency demultiplexer which comprises an input part with an input port, a low pass filter with an output port, and a band-pass filter with an output port.

The input part, the low-pass filter and the band-pass filter comprise open waveguide sections, and the band-pass filter comprises a plurality of gap-coupled resonators. The input part and the low-pass filter are both connected at respective connection points to one and the same of the gap-coupled resonators, with the connection point of the low-pass filter being located at a first maximum distance from a centre point of the resonator, and the connection point of the input part being located at a second maximum distance from said centre point of the resonator. The centre point of the resonator of the resonator corresponds to a wave node of a wavelength $\lambda$, where $\lambda=2d/M$, M is a positive integer value and d is the shortest end-to-end distance along the resonator.

By means of the frequency demultiplexer described above, manufacturing costs are lowered as compared to previous designs.

In embodiments of the frequency demultiplexer, the low-pass filter comprises stepped impedance sections.

In embodiments of the frequency demultiplexer, the input part comprises an impedance matching section between its input port and its connection point, the impedance matching section comprising a first section connected between second and third sections, where the first section has a greater width than the second and third sections.

In embodiments of the frequency demultiplexer, the first maximum distance from a centre point of the resonator is L/8, where L is the shortest end-to-end length along the first resonator In embodiments of the frequency demultiplexer, the second maximum distance from a centre point of the resonator is L/4 where L is the shortest end-to-end length along the first resonator.

The frequency demultiplexer described above is extremely versatile in that it can also be used in a frequency demultiplexer device in which more or less any number of such frequency demultiplexers are connected in cascade, in order to achieve a variety of different effects, all depending on the number and characteristics of the frequency demultiplexers comprised in the frequency demultiplexer device. Thus, such a frequency demultiplexer device with cascaded frequency demultiplexers comprises a plurality of N of the frequency multiplexer described above, in which the output port of the low pass filter of frequency multiplexer n in said plurality is connected to the input port of the connection part of frequency multiplexer n+1 (202) in said plurality.

In embodiments of the frequency multiplexer device, the band-pass filter and the low pass filter of frequency multiplexer n in said plurality are arranged so that the low pass filter has an upper cut-off frequency which overlaps partly or not at all with the pass-band of the band-pass filter, and the pass-band of the band-pass filter of multiplexer n+1 in said plurality is arranged to have its upper flank begin at a frequency higher than the cut-off frequency of the low-pass filter of multiplexer n in said plurality, but at a lower frequency than the upper flank of the band-pass filter of multiplexer n in said plurality.

The frequency demultiplexer described above and in the following is reciprocal, i.e. it can also be used as a frequency multiplexer. In such cases, i.e. when used as a frequency multiplexer, the input/output ports mentioned in the description of the frequency demultiplexer are used "in reverse", i.e. the output ports of the low pass filter and the band pass filter are used as input ports, and the input port of the input part is used as an output port. A plurality of such frequency multiplexers can also be combined into a frequency multiplexer device in a manner which is analogous to that of the frequency demultiplexer device described above.

BRIEF DESCRIPTION OF THE DRAWINGS

The invention will be described in more detail in the following, with reference to the appended drawings, in which.

DETAILED DESCRIPTION

Figure 1:
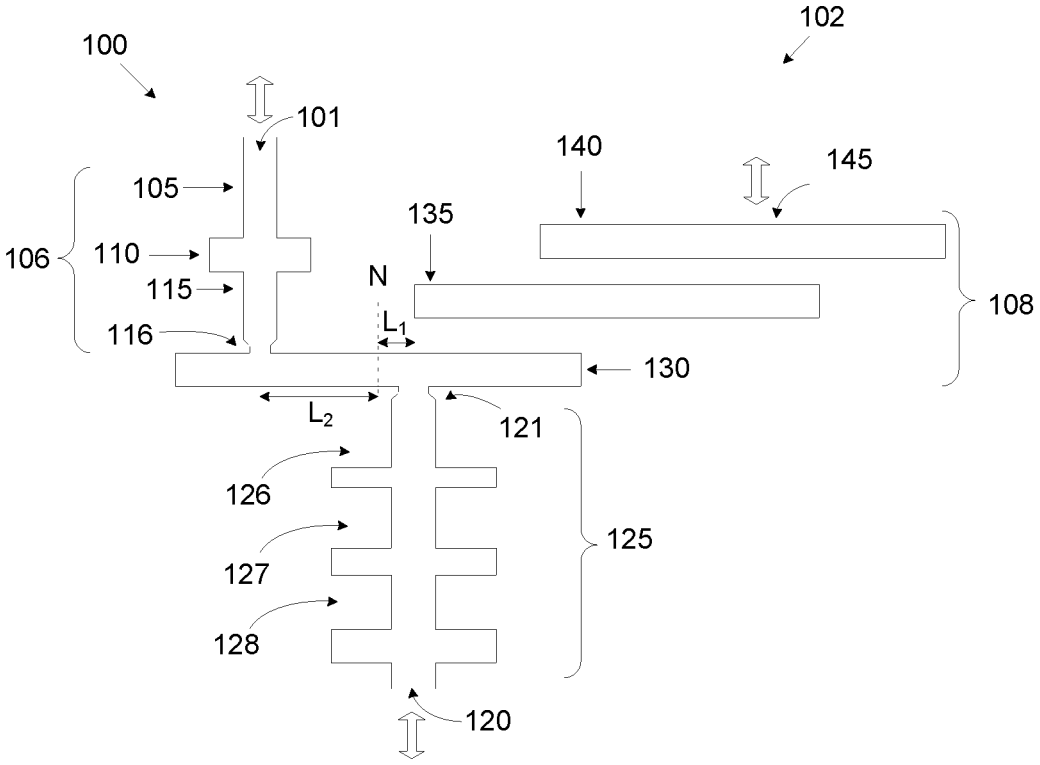
FIG. 1 shows a frequency demultiplexer.

Embodiments of the present invention will be described more fully hereinafter with reference to the accompanying drawings, in which embodiments of the invention are shown. The invention may, however, be embodied in many different forms and should not be construed as being limited to the embodiments set forth herein. Like numbers in the drawings refer to like elements throughout.

The terminology used herein is for the purpose of describing particular embodiments only, and is not intended to limit the invention.

Below, various embodiments of a frequency demultiplexer and of a frequency demultiplexer device will be described. The frequency demultiplexer device comprises one or more frequency demultiplexers which comprise sections of so called open waveguide technology, as opposed to closed waveguide technology. By "closed waveguide technology" we mean a waveguide with a closed cross-section, e.g. a rectangular, circular or elliptical cross-section. As opposed to this technology, open waveguide technology comprises at least one conducting strip and one ground plane or ground trace, and comprises technologies such as e.g. strip-line, microstrip and coplanar waveguides. Thus, although the embodiments below will be described as comprising microstrip technology, it should be pointed out that this is only in the interest of brevity, and that the embodiments described as well as the scope of protection sought encompasses open waveguide technology in general, e.g. strip-line and coplanar waveguides as well as microstrip technology.

As has also been pointed out above, the frequency demultiplexer and frequency demultiplexer device which will be described in the following are reciprocal, i.e. they can also be used for multiplexing. In such applications, the ports which are described below as output ports are used as input ports, and the ports which are described below as input ports are used as output ports.

FIG. 1 shows a "top view" of a first embodiment 100 of a frequency demultiplexer 102. The frequency demultiplexer 102 comprises an input part 106 which has an input port 101 and an output port 116, with the output port 116 being used as a connection point for the input part 106. Thus, the output port 116 will also in the following be referred to as a connection point for the input part 106.

The input part 106 also suitably but not necessarily comprises an impedance matching network, which comprises a wider section 110 located between two narrower sections 105, 115, i.e. a section 110 is connected in between two sections 105, 115 which are wider than the section 110. The impedance matching network can also comprise a chain of such alternating wider and narrower sections. Suitably, in such a chain, a narrower section such as the one 115 is located closer to the output port 116 than a wider section such as the one 110.

The frequency demultiplexer 102 also comprises a low-pass filter 125, which also has an input port 121 and an output port 120. The low-pass filter 125 can be designed according to a number of principles for such filters, e.g. stub filters and resonant stub filters, but in one embodiment, as shown in FIG. 1, the low-pass filter 125 comprises stepped impedance sections 126, 127, 128, located between the input and output ports. In the frequency demultiplexer 102, the input port 121 of the low-pass filter 125 is used as a connection point for the low-pass filter 125, for which reason the input port 121 will also be referred to as a connection point for the low pass filter 125 in the following.

The frequency demultiplexer also comprises a band-pass filter 108, which, as shown in FIG. 1, comprises a plurality of gap-coupled resonators 130, 135, 140. Naturally, the number of gap-coupled resonators can be varied so that it is either greater or lower than three; three is only an example of one embodiment of the band-pass filter 108. As shown in FIG. 1, the gap-coupled resonators are straight, elongated and rectangular; however, other shapes are also possible. In order to obtain the maximum bandwidth, the resonators 130, 135, 140 should be arranged in parallel to each other, as close to each other as possible, with an overlap between adjacent resonators of half of the total resonator length, but in applications with "relaxed" bandwidth requirements, smaller overlaps are possible. The band-pass filter 108 thus comprises a chain of gap-coupled resonators, where each resonator is arranged in parallel to two adjacent resonators, except for the "outermost" resonators, e.g. in this example resonators 130, 140, which only have one other resonator in parallel, on one of their sides.

In the frequency demultiplexer 102, the output port or connection point 116 of the input part 106 is connected to one of the gap coupled resonators, in this case the resonator 130, with the connection being located a maximum distance $L_2$ from a centre point N of the resonator 130. The centre point N shown in FIG. 1 coincides with the location of a so called wave node of an operational wavelength $\lambda$ of the band-pass filter. Thus, the centre point N can also be seen as a "wave node point". Depending on the operational frequency of the resonator and the length of the resonator, one or more wave nodes will occur in the resonator 130, and it is the distance from the point of such a wave node that is the maximum distance $L_2$. In general, regarding the operational wavelength $\lambda$ of the band-pass filter, the expression $\lambda=2d/K$ can be used, where K is a positive integer value and d is the shortest end-to-end distance along the resonator. As will be realized, depending on the frequency and on the length of the resonator 130, the centre point of the resonator 130 will not always be the location of a wave node point, as for example in an embodiment/frequency with two wave node points in the resonator 130.

As is also shown in FIG. 1, the port 121 of the low-pass filter 125 is connected to the resonator 130 at a maximum distance $L_1$ from the centre point N of the resonator. The explanation above regarding the location of the centre point N and the location of the wave nodes is valid here as well. It can be pointed out that the input part 106 and the low-pass filter 125 do not need to be connected on the same side of the centre point N, they can also be located on either side of the centre point N, as shown in FIG. 1, and, in the event of there being multiple wave nodes along a resonator, they can in fact be connected within their respective maximum distances from different wave nodes.

Suitably, the maximum distance $L_2$ from a centre point N of the resonator is L/4, where L is the shortest end-to-end length along the first resonator, and the maximum distance $L_1$ from a centre point of the resonator is L/8, where L is the shortest end-to-end length along the first resonator.

The gap-coupled resonator to which the low-pass filter and the input part are connected is suitably the innermost or outermost of the gap-coupled resonators, i.e. a gap-coupled resonator which is only connected to another resonator on one of its sides.

The connection points of the low pass filter 125 and the input part 106 to the band pass filter 108 serve as ports of the band pass filter 108 which connect the input part 106 and the low pass filter to the band pass filter 108.

The band-pass filter 108 also comprises an output port 145. This port can be designed in different ways, it can for example be a port connected to the resonator 140 similarly to the way that the input part 106 is connected to the resonator 130 ("tap coupling"), or by extending the "final", i.e. outermost, resonator 140 into a microstrip line.

Figure 2:
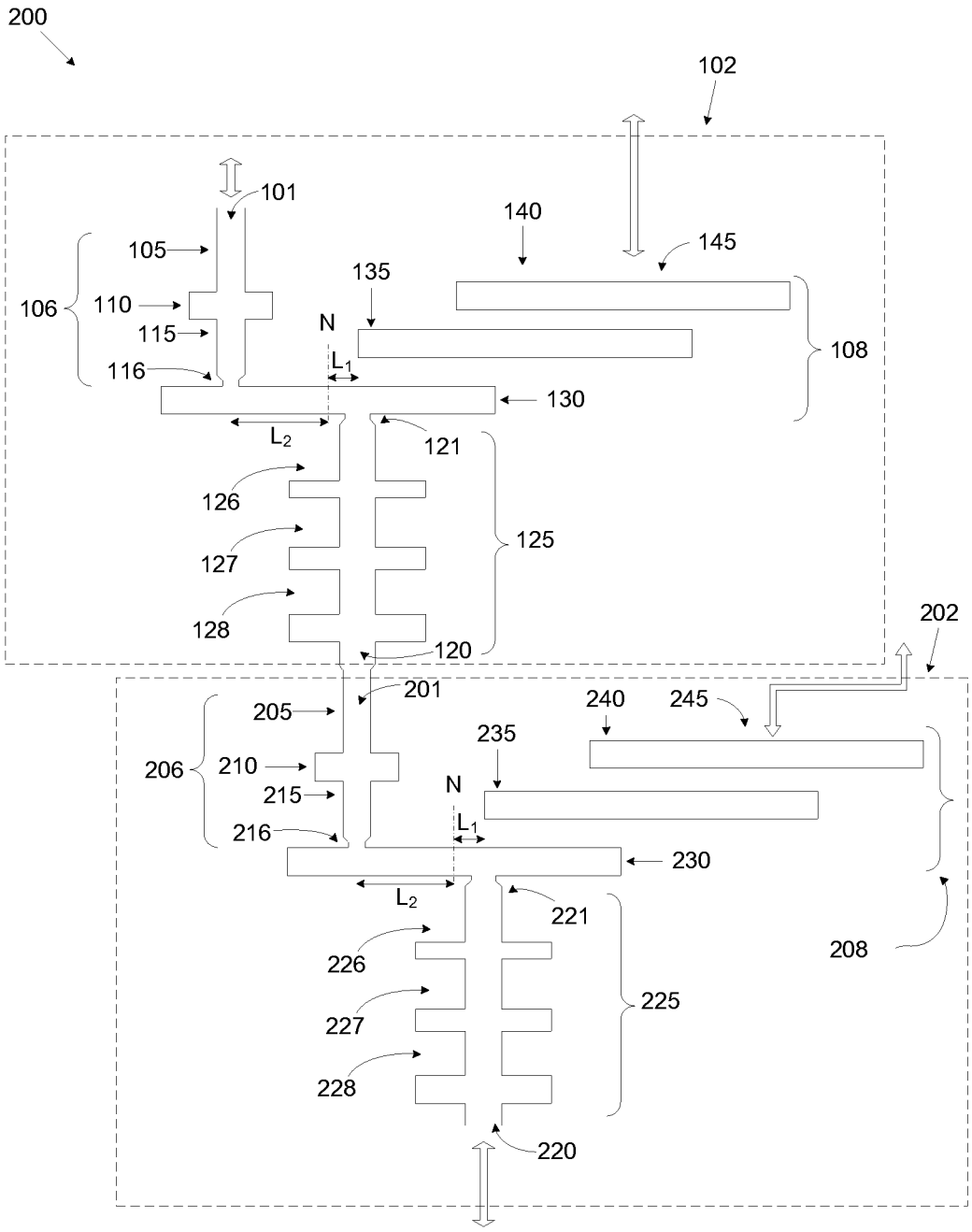
FIG. 2 shows a frequency demultiplexer device.

FIG. 2 shows a "top view" of a second embodiment 200 of a frequency demultiplexer device, which comprises two of the frequency demultiplexers shown in FIG. 1 and as described above. One of the frequency demultiplexers in the embodiment 200 has been given the reference number 102, as in FIG. 1, with all components numbered as in FIG. 1, and the other of the frequency demultiplexers has been given the reference number 202, with the components numbered as the frequency demultiplexer 102 of FIG. 1, although the first digit "1" has been replaced by a first digit "2", so that, for example, the low-pass filter of the frequency demultiplexer 202 is numbered 206, not 106. This principle, i.e. substituting a first digit "1" for a first digit "2" is used throughout for the frequency demultiplexer 202. The names of the components of the frequency demultiplexer 202 are the same as those used of the frequency demultiplexer 102.

The rules for the maximum distances $L_2$ and $L_1$ as described above in connection with FIG. 1 also apply for the frequency demultiplexer 202.

As shown in FIG. 2, in the frequency demultiplexer device 200, the output port 120 of the low-pass filter 125 of the frequency demultiplexer 102 is connected to the input port 201 of the input part 206 of the frequency demultiplexer 202. Thus, an output port 120 of the frequency demultiplexer 102 is connected to the input port of the frequency demultiplexer 202, i.e. the input port 201. In such an application, the output port 245 of the band-pass filter 208 becomes a second output port of the entire frequency demultiplexer device 200, with a pass-band below that of the band pass filter 108, and the output port 220 of the low pass filter 225 becomes a third output port of the frequency demultiplexer 200. If, for example, the output from the low pass filter 225 at the output port 220 is not of interest, the output port 220 of the low-pass filter 225 can be terminated, e.g. by means of a matched load.

FIG. 2 thus shows how two or more of frequency demultiplexers such as the one 102 of FIG. 1 can be "cascaded" in order to achieve a frequency demultiplexer device with different effects, depending on how the low-pass and band-pass filters of the cascaded frequency demultiplexers are designed. Some examples of such effects which can be obtained will now be described with reference to FIGS. 3*a*-3*c*.

Figure 3:
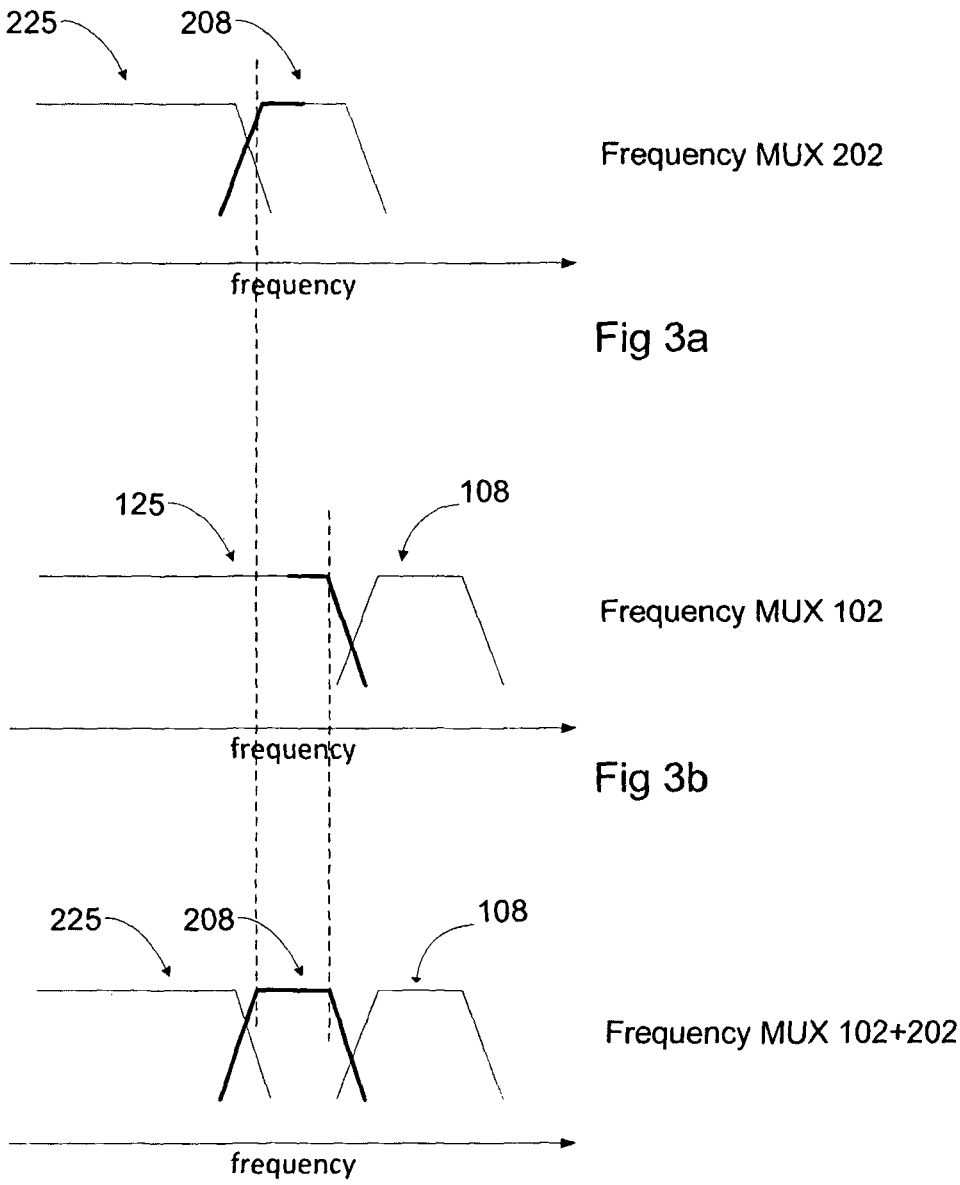
FIGS. 3*a*-3*c* show filter characteristics of the frequency demultiplexer device of FIG. 2.

FIG. 3*a* shows the characteristics of the band-pass filter 208 and the low-pass filter 225 in one embodiment of the frequency demultiplexer 202: the low-pass filter 225 has a cut-off frequency which overlaps partly with the pass-band of the band-pass filter 208, i.e. the lower flank of the pass-band of the band-pass filter 208 and the cut-off frequency of the low-pass filter overlap slightly. In other embodiments, the lower flank of the pass-band of the band-pass filter 208 and the cut-off frequency of the low-pass filter 225 can be arranged to have no overlap at all.

FIG. 3*b* shows the characteristics of the band-pass filter 108 and the low-pass filter 125 in one embodiment of the frequency demultiplexer 102: the low-pass filter 125 has a cut-off frequency which overlaps partly with the pass-band of the band-pass filter 108, i.e. the lower flank of the pass-band of the band-pass filter 108 and the cut-off frequency of the low-pass filter overlap slightly. In other embodiments, the lower flank of the pass-band of the band-pass filter 108 and the cut-off frequency of the low-pass filter 125 can be arranged to have no overlap at all.

FIG. 3*c* shows an effect which can be achieved if the filters of the two frequency demultiplexers 102, 202 are arranged in a certain way: in addition to the conditions given above and shown in FIGS. 3*a* and 3*b*, the pass-band of the band-pass filter 208 of the frequency demultiplexer 202 is arranged to have its upper flank at a frequency higher than the cut-off frequency of the low-pass filter 125 of the frequency demultiplexer 102, but at a lower frequency than the upper flank of the band-pass filter 108 of the frequency demultiplexer 102. This arrangement enables the frequency demultiplexer device 200 to "cut out" a certain frequency range, which essentially corresponds to the pass-band of the band-pass filter 208 of the frequency demultiplexer 202, but where the upper "band edge" s set by the LP filter 125. This frequency range can then be accessed at the port 245 of the band-pass filter 208. At the port 220, frequencies below the cut-off frequency of the low-pass filter 225 can be accessed.

A number of principles enabled by the frequency demultiplexer 102 will now be realized, and will be explained below, using the following terminology:

Low pass, LP output port of a frequency demultiplexer: this term is used to signify the output ports 120, 220, of the low pass filters 125, 225.

Band pass, BP output port of a frequency demultiplexer: this term is used to signify the output ports 145, 245 of the band pass filters.

A more or less arbitrary number of frequency demultiplexers can be cascaded, as with the two frequency demultiplexers in FIG. 2, using the following principle: If the cascaded frequency demultiplexers are referred to sequentially as A, B, etc, then, in such a cascaded arrangement, the LP-output port of frequency demultiplexer A is connected to the input port of frequency demultiplexer B.

The upper flank of the band-pass filter of frequency demultiplexer B is placed slightly above the cut-off frequency of the low-pass filter of frequency demultiplexer A. In this case, the bandwidth edges at the BP-output port of frequency demultiplexer B are determined by the low-pass filter of frequency demultiplexer A from above, and by the band-pass filter of frequency demultiplexer B from below.

Spurious pass-bands are completely eliminated through the use of low-pass filters with progressively lower and lower cut off frequency.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation.

The invention is not limited to the examples of embodiments described above and shown in the drawings, but may be freely varied within the scope of the appended claims.

The invention claimed is:

1. A frequency demultiplexer comprising an input part with an input port, a low pass filter with an output port, and a band-pass filter with an output port, with the input part, the low-pass filter and the band-pass filter comprising open waveguide sections, and the band-pass filter comprising a plurality of gap-coupled resonators, with the input part and the low-pass filter both being connected at respective connection points to one and the same of said gap-coupled resonators, the connection point of the low-pass filter being located at a first maximum distance from a center point of the resonator and the connection point of the input part being located at a second maximum distance from said center point of the resonator, said center point corresponding to a wave node of a wavelength $\lambda$, where $\lambda=2d/M$, M is a positive integer value and d is the shortest end-to-end distance along the resonator, in which the first maximum distance from said center point of the resonator is d/8 and the second maximum distance from said center point of the resonator is d/4.

2. The frequency demultiplexer of claim 1, in which the low-pass filter comprises stepped impedance sections.

3. The frequency demultiplexer of claim 1, in which the input part comprises an impedance matching section between said input port of the input part and said respective connection point at which the input part is connected to said gap-coupled resonators, said impedance matching section comprising a first section connected between second and third sections, where the first section has a greater width than the second and third sections.

4. A frequency demultiplexer device, comprising a first and a second frequency demultiplexer of claim 1, in which the output port of the low pass filter of the first frequency demultiplexer is connected to the input port of the input part of the second frequency demultiplexer.

5. The frequency demultiplexer device of claim 1, wherein the band-pass filter and the low pass filter of the first frequency demultiplexer are arranged so that the low pass filter has an upper cut-off frequency which overlaps partly or not at all with the pass-band of the band-pass filter, and the pass-band of the band-pass filter of the second frequency demultiplexer is arranged to have its upper flank begin at a frequency higher than the cut-off frequency of the low-pass filter of the first frequency demultiplexer, but at a lower frequency than the upper flank of the band-pass filter of the first frequency demultiplexer.

* * * * *